United States Patent [19]

Birö et al.

[11] 4,368,723

[45] Jan. 18, 1983

[54] HEATING APPARATUS FOR BURNING LUMPY FUELS, FIRST OF ALL TO MEET THE HEAT DEMAND OF FAMILY HOMES AND INDIVIDUAL FLATS, OR A SMALL GROUP OF THEM

[76] Inventors: Ernö Birő; Ernö Birő, both of Urbantsokk u. 37, Györ, Hungary

[21] Appl. No.: 242,316

[22] Filed: Mar. 10, 1981

[30] Foreign Application Priority Data

Mar. 11, 1980 [HU] Hungary ..... 564

[51] Int. Cl.[3] ..... F23H 9/02

[52] U.S. Cl. ..... 126/181; 110/276

[58] Field of Search ..... 126/152 R, 152 B, 163 R, 126/163 A, 181, 182; 110/270, 276, 275

[56] References Cited

U.S. PATENT DOCUMENTS

| | | | |
|---|---|---|---|
| 2,501,763 | 3/1950 | Denker et al. | 110/276 |
| 2,825,293 | 3/1958 | Benoit-Cattin | 126/181 |

FOREIGN PATENT DOCUMENTS

| | | | |
|---|---|---|---|
| 450357 | 9/1927 | Fed. Rep. of Germany | 126/163 |
| 1176783 | 8/1964 | Fed. Rep. of Germany . | |
| 1943855 | 3/1971 | Fed. Rep. of Germany . | |
| 756813 | 12/1933 | France | 110/276 |
| 849775 | 12/1939 | France | 126/181 |
| 185884 | 11/1936 | Switzerland . | |
| 9555 | of 1913 | United Kingdom . | |
| 892230 | 3/1962 | United Kingdom . | |
| 1078381 | 8/1967 | United Kingdom . | |
| 2156918 | of 0000 | U.S.S.R. . | |

*Primary Examiner*—James C. Yeung

[57] ABSTRACT

The invention relates to heating apparatus the use of which is recommended to meet the heat demand first of all of family homes and individual flats, or a small group of them.

Substance of the heating apparatus according to the invention is, that it has grate construction connected with actuating mechanism, the open, hollow grate elements of which provided with air outlet openings at least at one of their ends are arranged along endless surface, furthermore it has air inlet head fitted to at least one of the front ends of the grate construction.

It is advisable to form the grate elements from tubes and to arrange them along cylindrical surface.

6 Claims, 4 Drawing Figures

HEATING APPARATUS FOR BURNING LUMPY FUELS, FIRST OF ALL TO MEET THE HEAT DEMAND OF FAMILY HOMES AND INDIVIDUAL FLATS, OR A SMALL GROUP OF THEM

FIELD AND BACKGROUND OF THE INVENTION

The invention relates to heating apparatus the use of which is recommended first of all to meet the heat demand of family homes and individual flats, or a small group of them. Lumpy fuel as used in connection with the invention should be understood to be coal, brown coal, or refined fuel, e.g. briquette and similar materials.

Household heating apparatus is the name of those used to meet the heat demand of individual flats, family homes, or a small group of them. Heat demand means the totality of the heat demand ensuring heating and hot water supply. Accordingly household heating apparatus as used in connection with the invention may be an apparatus similar to stove, or the central boiler of the hot water heating system and other similar apparatuses.

It is generally known, that only those heating apparatuses, used to meet the household heat demand, are suited to the heating technical aspects, in which liquid or gaseous hydrocarbons are burnt. It is a known fact, that the mentioned hydrocarbon types are available for household purpose only in limited quantity. In view of this, the solid lumpy fuels again come into the foreground to meet the household heat demand.

For the continuous operation of the heating apparatuses used for burning lumpy fuels, the feeding of fuel, removal of ash and cinders and automation of the capacity variation are solved only with heating apparatuses of such capacity category, which serve industrial purposes, for instance, with furnaces used for boilers of a power plant. Mechanical grates are used in the industrial furnaces of the mentioned capacity category, such as the chain grates, travelling grates, understokers, overfeed stokers, invert stokers, their various modifications and alternatives. These known furnaces are not applicable in connection with those used for household purposes, hence they did not gain general acceptance in the latter capacity categories. The industrial furnaces are designed generally for a fixed coal type and, consequently, the coal feeding auxiliary plant, the device used for induction and distribution of the air, the device for the removal of ash and cinder, and the automation realizing the functional coordination of the mentioned detail solutions, and designed accordingly.

It is obvious, that in case of the household heating apparatuses no solution will be acceptable, that is suitable for the burning of only one coal type. The lumpy fuels used for household purposes vary not only annually, but even within the same heating season. The households are supplied with coal types of generally poor quality, the dust-content, grain size and moisture content of which vary within wide limits. Occasionally caking, in other cases non-caking cinder type coals are available. Such considerable variations actually require different household apparatuses and often radically different heating technology and fire control.

The most important requirements imposed on the household heating apparatuses are the following:

Effective combustion of fuel and utilization of the heat arising during combustion. No, or only minimal supervision in the process of operation. Continuous heating. In addition to above, the simple construction, inexpensive production and upkeep, furthermore minimal self-consumption are fundamental requirements.

None of the known heating apparatuses used for burning fuels is capable to meet the listed requirements. The known apparatuses generally have vertical grate. The result is that such lumpy cinder piles up on the grate during the process of burning, which can not fall through the gaps even when the grate is stirred. The accumulating cinder represents considerable flow resistance against the combustion air to be induced from underneath, thus flow of the air into the combustion zone necessary for combustion will be uneven during the time of heating. This process will last until the amount of air flowing into the required zone will diminish to such extent, that ignition and combustion can no longer occur. In short, the fire goes out and it can not be restarted until the heating space and grate are cleaned. This process, namely extinction of the fire, is highly dependent on the coal type in connection with the known household heating apparatuses. In case of coal types with caking cinder, the cinder cake forming on the grate renders the combustion in the heating apparatus impossible within a short time. Under such circumstances no effective heating or continuous combustion is conceivable in case of the traditional heating apparatuses. On the other hand these heating apparatuses require relatively a lot of maintenance work and handling activity.

There are so-called slow-combustion stoves, which however are not up to their name referring to continuous operation exactly because of the extremely variable quality and physical condition of the available coal types. These heating apparatuses have not solved either the earlier outlined general problems in the field of household heating apparatuses.

SUMMARY OF THE INVENTION

The heating apparatus according to the invention represents a fundamental change compared to the known solutions of the household heating apparatuses and it meets the requirements imposed on these apparatuses nearly to full expectations.

The object of the invention is that the present apparatus shall not be sensitive to the available coal type, it shall ensure continuous heating in such a way, that the personal attendance is restricted only to the periodical feeding of the raw fuel and emptying the ash space, and in addition to this it shall ensure the availability of combustion air in time and space and in adequate quantity.

The heating apparatus according to the invention contains a mobile grate construction formed by hollow grate elements for guiding and releasing the air necessary for the combustion. The grate elements are arranged along endless surface, such as on the mantle of cylindrical surface, each grate element in the direction of the generatrix. Air inlet head is connected to one or both front ends of the grate construction supplying those grate elements with air, which support the burning fuel. The air outlet openings are on the outward mantle-parts of the grate elements. It is advisable to use such drum plates at the front ends of the grate, which partly fix the grate elements and partly are connected with the shaft of the grate construction, thus the shaft and grate elements are held together as a mechanical unit. The whole grate construction is driven by the shaft with a motor of very low power output, since the speed of the rate construction is very low. The air inlet head is connectible to one or both drum plates forming the front ends of the earlier mentioned grate construction. This connection shall ensure sliding fit, i.e. the drum plate slides along the connecting plane of the air inlet head, but airtight fit is necessary along the plane. In order to ensure the airtight fit, such device may be used, where a ring is fixed at the outer side of the drum plate extending to the vicinity of the outlets of the grate elements and the air inlet head is fitted to this ring. It is advisable to insert a flexible element between the air inlet head and connecting tube, in order that seating of the air inlet head should follow the irregularities of the fitting plane. Such flexible element may be preferably a tube membrane.

Substance of the heating apparatus according to the invention is that it has such grate construction connected with actuating mechanism, the hollow grate elements of which open at least at one end and being provided with air outlet openings which are arranged along an endless surface, furthermore it has air inlet head fitting to at least one front end of the grate construction.

In a preferred construction of the heating apparatus according to the invention the grate elements are tubes arranged along a cylindrical mantle.

A suitable construction of the heating apparatus according to the invention is represented by the solution at which the ends of the grate elements are connected to drum plates, which are fixed to a shaft.

In case of another preferred construction a ring is connected to the ends of the grate elements at the outer side of at least one drum plate.

According to the recommended solution the size and position of the air inlet head shall be suitable for connection to several grate elements at the same time.

BRIEF DESCRIPTION OF THE DRAWINGS

The heating apparatus according to the invention is describe in detail by way of example in the enclosed drawings, in which.

DESCRIPTION OF THE PREFERRED EMBODIMENT

Figure 1:
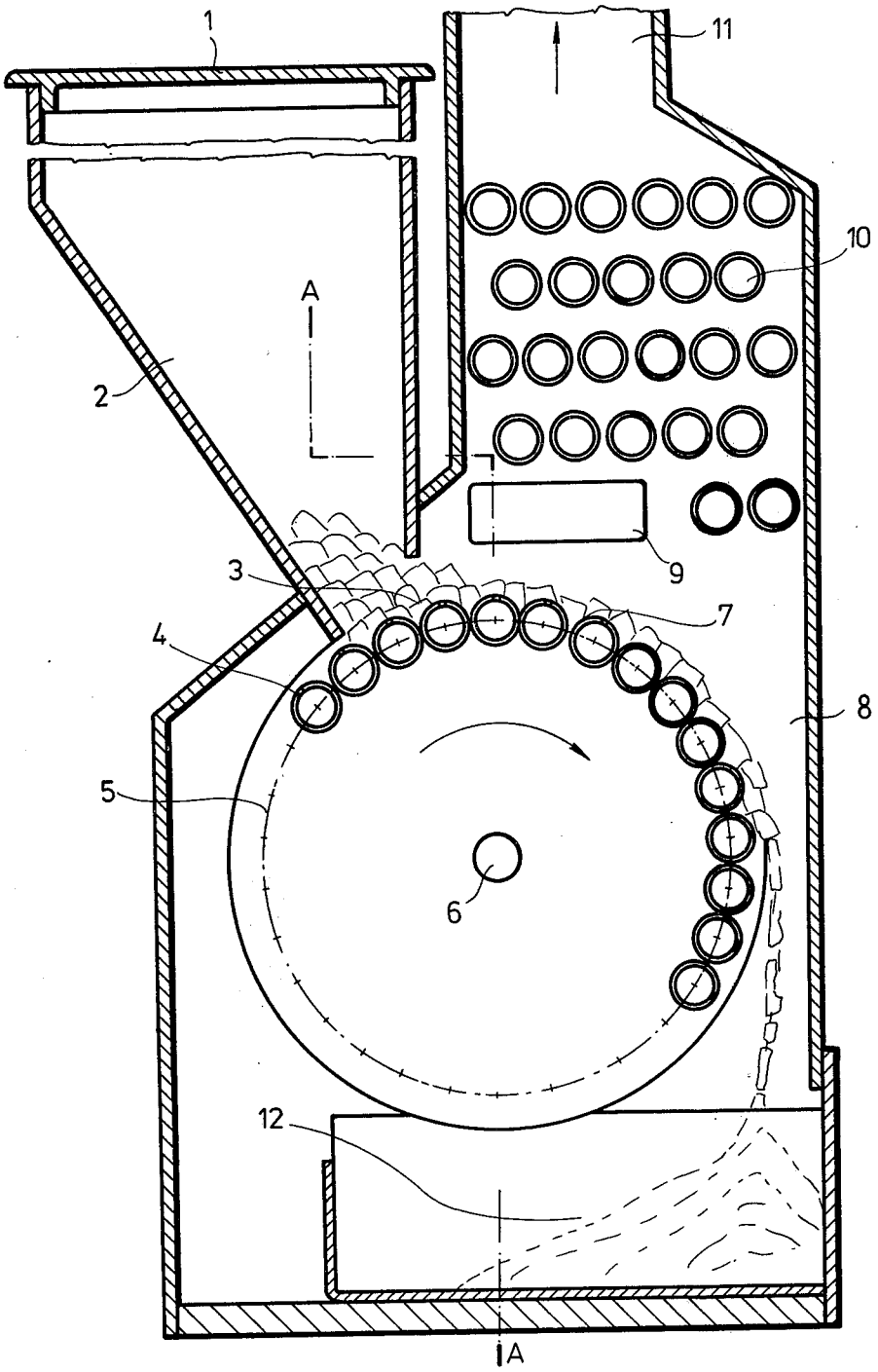
FIG. 1. Sectional view of the construction of the heating apparatus according to the invention by way of example.
Figure 2:
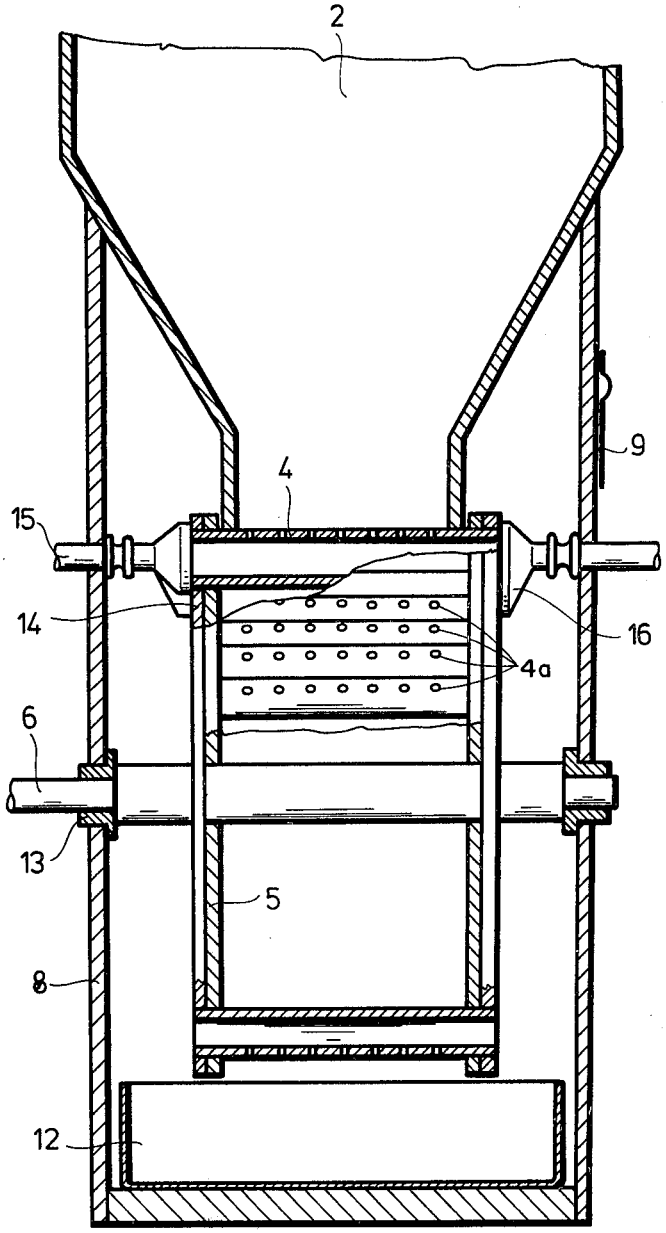
FIG. 2. Section along planes A—A marked in FIG. 1.

In the heating apparatus shown by way of example, the grate construction has a horizontally arranged cylindrical shape in the space surrounded by side walls 8. The grate construction includes grate elements 4 arranged in the direction of the generatrix, drum plates 5 forming the front ends of the grate construction, rings 14, and shaft 6. The shaft 6 is connected with a driving mechanism/not shown/ to actuate the grate construction. Generally electric motor driven driving gear is used to ensure the very low speed for the shaft 6. The shaft 6 is embedded in the side walls 8 supported by bearings 13.

The grate elements 4 of the grate construction at the novel heating apparatus are in fixed position in relation to the drum plates 5 and rings 14. In the grate construction shown by way of example the grate elements 4 are made of tubes open at both ends. The outward looking mantle parts of the grate elements 4 are provided with holes **4*a*** used as air outlet openings.

Figure 3:
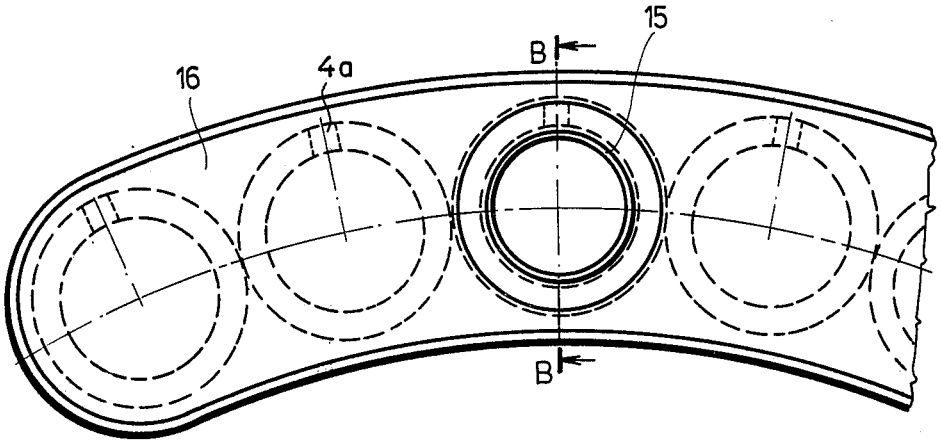
FIG. 3. Side view of the air inlet head.
Figure 4:
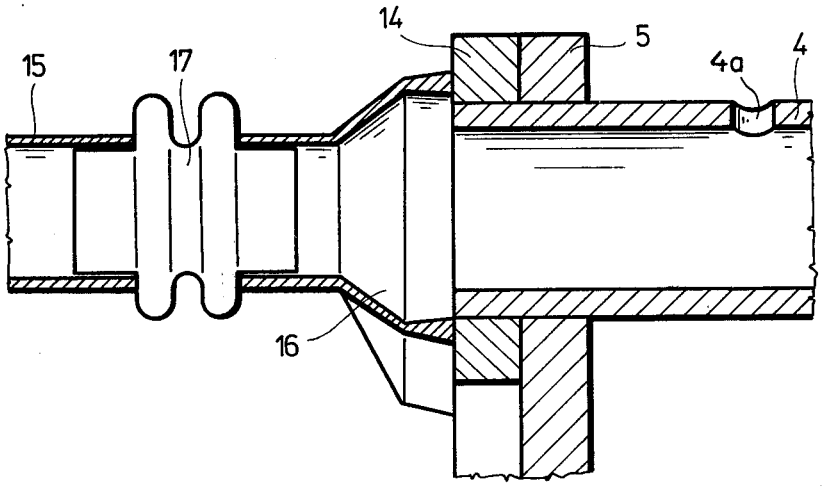
FIG. 4. Section along plane B—B marked in FIG. 3.

Air inlet heads or manifolds 16 are fitted to both front ends of the grate construction. The air inlet heads 16 are connected with tubes 15, which in turn are connected to a fan or some kind of blower not shown. The head 16 is suitably curved, as shown in FIG. 3, and its size is suitable to receive the outlets of several grate elements at the same time, i.e. it is capable to supply several grate elements 4 with air. In the embodiment shown by way of example the openings of five grate elements 4 are covered by one head 16. According to the general requirement one head 16 covers the outlet of as many grate elements 4, as there are directly under the burning coal layer. Between the air inlet head 16 and front end of the grate construction the fit shall enable the rotation of the grate construction in relation to the head 16 without allowing the escape of significant amount of air along the fitting plane of the head 16. In order to ensure this objective, it is advisable to use a ring 14 that is fixed to the outer side of drum plate 5 according to FIG. 4, and the outer plane of which is a machined surface, which supports the head 16. In order that the head 16 should be properly seated on the drum plate 5 forming the front end of the grate construction or on the ring 14 in spite of minor irregularities, flexible support has to be provided. For this purpose tube membrane 17 is inserted between the head 16 and tube 15.

The heating apparatus according to the invention still includes conventional tank 2 for the raw fuel. Its upper part is closed by cover 1, while its bottom part has a hopper 3 connected to the grate construction. Heating space 7 is formed at the hopper 3 above the grate construction. Boiler tubes 10 for heating and producing hot water are arranged in the shaft-like section above the heating space 7 in the heating apparatus described by way of example. The flue gases pass of through throat 11 above the boiler tubes 10 towards the chimney as shown by the arrows. Ignition hole 9 is on the side wall 8 in the vicinity of the heating space 7, which is actually a cutout closed with a door. Ash dump or box 12 is formed below the grate construction provided similarly with a door.

During operation of the heating apparatus according to the invention the fuel fed via the hopper 3 onto the upper part of the grate construction is ignited through the ignition hole 9. The air necessary for ignition of the fuel and to supply the combustion is ensured via tubes 15, heads 16 and grate elements 4 connected to the heads 16 through the air outlet openings of the latter ones. During operation of the heating apparatus an actuating device, not shown, connected to the shaft 6 ensures rotation of the grate construction according to the curving arrows shown in FIG. 1. During rotation of the grate construction the fuel in the upper part of the grate construction passes from left to right according to FIG. 1. The fuel passing by is resupplied with the raw fuel forwarded through the hopper 3 onto the grate construction. Remnant of the burnt off fuel slides down into the ash dump 12. Speed of the shaft 6 is selected and adjusted in such a way, that the fuel on the upper part of the grate construction should burn off completely. The amount of fuel fed through hopper 3, and thus the layer thickness of the fuel in the heating space, can be varied with the aid of a push plate used in the vicinity of the hopper. This push plate is not illustrated in the drawings.

During operation of the heating apparatus according to the invention, it can not happen that the cinder and ash remaining after the burnt fuel accumulate below the fresh fuel would and thus prevent the ignition and combustion of the fuel, since the grate construction itself ensures the removal of cinder and ash from the heating space 7. Movement of the grate construction and the air flowing out of the grate elements 4 through holes 4*a* represent the stirring of the burning fuel to a certain extent, resulting in better combustion of the fuel's carbon content and in reducing the loss of combustible cinder.

The personal attendance of the heating apparatus according to the invention is restricted to refilling the tank 2 and emptying the ash dump 12. This activity will be necessary only once a week, when the apparatus is correctly dimensioned. Capacity variation of the proposed heating apparatus is ensured by varying the inducted amount of air, and possibly by varying the opening between the hopper 3 and grate construction. Variation of the speed of shaft 6 and that of the inducted amount of air are automated in a simple way with the aid of conventional devices.

In connection with description of the construction by way of example it is apparent, that the heating apparatus according to the invention has a simple construction, its production does not require special technology, hence, it is inexpensive. In spite of this, it ensures the efficient burning of any lumpy fuel. The proposed heating apparatus is not demanding in respect of the varying quality and physical properties of the fuels to be burnt. It does not require permanent supervision and handling, furthermore its maintenance is insignificant. If necessary, its operation can be mostly automated.

What we claim is:

1. Heating apparatus for burning lumpy fuel, including a rotary grate means, driving mechanism for said grate means, the grate means comprising a plurality of open, hollow tube-shaped grate elements (4) provided with air outlet openings, said grate elements are arranged along an endless cylindrical mantle surface of said grate means, adjacently lying ones of said tube-shaped grate elements being fixed to each other at their side portions for forming said cylindrical surface, said air outlet openings being provided on the outwardly lying surface of said tube-shaped grate elements, an air inlet head (16) fitted to at least one of the front ends of the grate means and communicating with at least one of said tube-shaped elements.

2. Heating apparatus as claimed in claim 1, characterized in that the ends of the grate elements /4/ are connected to drum plates /5/ and the drum plates /5/ are fixed to a shaft /6/.

3. Heating apparatus as claimed in claim 2, characterized in that a ring /14/ connected to the ends of the grate elements /4/ is at the outer side of at least one of the drum plates /5/.

4. Heating apparatus as claimed in claim 3, characterized in that the air inlet head /16/ is connected with sliding fit either to a section of the drum plate /5/, or to a section of the ring /14/.

5. Heating apparatus as claimed in claim 4, characterized in that the size and position of the air inlet head /16/ are suitable for connection to the openings of several grate elements /4/ at the same time.

6. Heating apparatus as claimed in claim 5, characterized in that flexible element, preferably tube membrane /17/ is inserted between the air inlet head /16/ and connecting tube /15/.

* * * * *